US007278978B1

(12) United States Patent
Hansen et al.

(10) Patent No.: US 7,278,978 B1
(45) **Date of Patent: *Oct. 9, 2007**

(54) RESPIRATORY VEST WITH INFLATABLE BLADDER

(75) Inventors: Craig N. Hansen, Plymouth, MN (US); Lonnie J. Helgeson, New Prague, MN (US)

(73) Assignee: Electromed, Inc., New Prague, MN (US)

( * ) Notice: Subject to any disclaimer, the term of this patent is extended or adjusted under 35 U.S.C. 154(b) by 569 days.

This patent is subject to a terminal disclaimer.

(21) Appl. No.: 10/646,357

(22) Filed: Aug. 22, 2003

Related U.S. Application Data

(63) Continuation-in-part of application No. 09/902,471, filed on Jul. 10, 2001, now Pat. No. 6,676,614.

(51) Int. Cl.
*A61H 31/00* (2006.01)

(52) U.S. Cl. ..... 601/41; 601/DIG. 7; 601/DIG. 11

(58) Field of Classification Search ..... None
See application file for complete search history.

(56) References Cited

U.S. PATENT DOCUMENTS

| | | | | |
|---|---|---|---|---|
| 2,223,570 A | | 12/1940 | McMillin | |
| 2,354,397 A | | 7/1944 | Miller | |
| 2,529,258 A | * | 11/1950 | Lobo | 601/44 |
| 2,588,192 A | * | 3/1952 | Akerman et al. | 601/44 |
| 2,648,325 A | * | 8/1953 | Siple | 126/204 |
| 2,707,948 A | | 5/1955 | Emerson | |
| 2,762,366 A | | 9/1956 | Huxley, III et al. | |
| 2,779,329 A | | 1/1957 | Huxley, III et al. | |
| 2,780,222 A | | 2/1957 | Polzin et al. | |
| 2,869,537 A | | 1/1959 | Chu | |
| 2,899,955 A | | 8/1959 | Huxley, III et al. | |
| 3,043,292 A | | 7/1962 | Mendelson | |
| 3,063,444 A | | 11/1962 | Jobst | |
| 3,078,842 A | | 2/1963 | Gray | |
| 3,120,228 A | | 2/1964 | Huxley, III | |
| 3,179,106 A | | 4/1965 | Merefith | |
| 3,310,050 A | | 3/1967 | Goldfarb | |
| 3,545,017 A | | 12/1970 | Cohn | |
| 3,566,862 A | | 3/1971 | Schuh | |
| 3,577,977 A | | 5/1971 | Ritzinger, Jr. et al. | |

(Continued)

FOREIGN PATENT DOCUMENTS

| | | |
|---|---|---|
| CA | 1225889 | 8/1987 |

OTHER PUBLICATIONS

"Nitrogen Washout during Tidal Breathing with Superimposed High-Frequency Chest Wall Oscillation," Am. Review of Respiratory Disease, V. 132(2), Aug. 1985, pp. 350-353.

(Continued)

*Primary Examiner*—Danton DeMille

(57) ABSTRACT

A vest for a supine human has a one-piece cover with a front panel secured to a bladder coupled to a pulsator operable to subject the vest to repeated pulses of air which applies and releases pressure to the front of the thorax of a person. The bladder has an air chamber and a bottom transverse portion having an air receiving passage and openings to allow air to flow from the air receiving passage into the air chamber. A coil spring within the air receiving passage maintains the air receiving passage open to allow air and air pressure pulses to flow into the air chamber.

39 Claims, 6 Drawing Sheets

U.S. PATENT DOCUMENTS

| | | | | |
|---|---|---|---|---|
| 3,683,655 | A | | 8/1972 | White et al |
| 3,760,801 | A | | 9/1973 | Borgeas |
| 3,993,053 | A | | 11/1976 | Grossan |
| 4,004,579 | A | | 1/1977 | Dedo |
| 4,120,297 | A | | 10/1978 | Rabischong et al. |
| 4,135,503 | A | | 1/1979 | Romano |
| 4,178,922 | A | | 12/1979 | Curlee |
| 4,186,732 | A | | 2/1980 | Christoffel |
| 4,375,217 | A | | 3/1983 | Arkans |
| 4,402,312 | A | * | 9/1983 | Villari et al. ..... 601/152 |
| 4,424,806 | A | | 1/1984 | Newman et al. |
| 4,523,579 | A | | 6/1985 | Barry |
| 4,577,626 | A | | 3/1986 | Marukawa et al. |
| 4,590,925 | A | | 5/1986 | Dillon |
| 4,621,621 | A | | 11/1986 | Marsalis |
| 4,637,074 | A | | 1/1987 | Taheri |
| 4,676,232 | A | | 6/1987 | Olsson et al. |
| 4,682,588 | A | | 7/1987 | Curlee |
| 4,815,452 | A | | 3/1989 | Hayek |
| 4,838,263 | A | | 6/1989 | Warwick et al. |
| 4,840,167 | A | | 6/1989 | Olsson et al. |
| 4,928,674 | A | | 5/1990 | Halperin et al. |
| 4,930,498 | A | | 6/1990 | Hayek |
| 4,952,095 | A | | 8/1990 | Walters |
| 4,977,889 | A | | 12/1990 | Budd |
| 4,979,375 | A | * | 12/1990 | Nathans et al. ..... 62/259.3 |
| 5,007,412 | A | | 4/1991 | DeWall |
| 5,055,052 | A | | 10/1991 | Johnsen |
| 5,056,505 | A | | 10/1991 | Warwick et al. |
| 5,222,478 | A | | 6/1993 | Scarberry et al. |
| 5,235,967 | A | | 8/1993 | Arbisi et al. |
| 5,245,990 | A | | 9/1993 | Bertinin |
| 5,370,603 | A | | 12/1994 | Newman |
| 5,453,081 | A | | 9/1995 | Hansen |
| 5,490,820 | A | | 2/1996 | Schock et al. |
| 5,494,469 | A | | 2/1996 | Heath et al. |
| 5,569,170 | A | | 10/1996 | Hansen |
| D379,396 | S | | 5/1997 | Rongo et al. |
| 5,674,269 | A | | 10/1997 | Augustine |
| 5,769,797 | A | | 6/1998 | Van Brunt et al. |
| 5,769,800 | A | | 6/1998 | Gelfand et al. |
| 5,800,489 | A | * | 9/1998 | Augustine ..... 607/107 |
| 5,938,627 | A | | 8/1999 | Hickman |
| 6,036,662 | A | | 3/2000 | Van Brunt et al. |
| 6,155,996 | A | | 12/2000 | Van Brunt et al. |
| 6,254,556 | B1 | | 7/2001 | Hansen et al. |
| 6,379,316 | B1 | | 4/2002 | Van Brunt et al. |
| D456,591 | S | | 5/2002 | Hansen |
| D461,897 | S | | 8/2002 | Hansen et al. |
| 6,471,663 | B1 | | 10/2002 | Van Brunt et al. |
| 6,488,641 | B2 | | 12/2002 | Hansen |
| D469,876 | S | | 2/2003 | Hansen et al. |
| 6,547,749 | B2 | | 4/2003 | Hansen |
| 6,605,050 | B2 | | 8/2003 | Hansen |
| 2005/0143796 | A1 | * | 6/2005 | Augustine et al. ..... 607/104 |

OTHER PUBLICATIONS

"High Frequency Chest Wall Oscillation in Patients with Chronic Air-Flow Obstruction," Am. Review of Respiratory Disease, V. 132(2), Dec. 1987, pp. 1355-1359.

"High-Frequency Chest Wall Oscillation," Chest, Feb. 1986, pp. 218-223.

"Effect of Chest Wall Oscillation on Mucus Clearance: Comparison of Two Vibrators," Pediatric Pulmonology, Mar. 1989, pp. 122-126.

"The Long-Term Effect of High-Frequency Chest Compression Therapy on Pulmonary Complications of Cystic Fibrosis," Pediatric Pulmonology, Nov. 1991, pp. 265-271.

"Effects of high frequency chest compression on respiratory systems mechanics in normal subjects and cystic fibrosis patients," Canadian Respiratory Journal, Mar. 1995, pp. 40-46.

"Chronic bronchial asthma and emphysema," Geriatrics, Jun. 1996, pp. 139-158.

"Enhanced Tracheal Mucus Clearance with High Frequency Chest Wall Compression," Respiratory Disease, Sep. 1983, pp. 511-515.

"Peripheral mucociliary clearance with high-frequency chest wall compression." Journal of Applied Physiology; Apr. 1985, pp. 1157-1163.

"Tracheal mucus clearance in high-frequency oscillation: effect of peak flow rate bias," The European Respiratory Journal, Jan. 1990, pp. 6-13.

"High-frequency Chest Compression System to Aid in Clearance of Mucus from the Lung." Biomedical Instrumentation & Technology, Jul. 1990, pp. 289-294.

"Preliminary Evaluation of High-Frequency Chest Compression for Secretion Clearance in Mechanically Ventilated Patients," Respiratory Care, Oct. 1993, pp. 1081-1087.

"Artificial Ventilation," Technion Institute of Technology Faculty of Medicine, date unknown.

* cited by examiner

RESPIRATORY VEST WITH INFLATABLE BLADDER

CROSS REFERENCE TO RELATED APPLICATION

This application is a continuation-in-part of U.S. application Ser. No. 09/902,471 filed Jul. 10, 2001 now U.S. Pat. No. 6,676,614.

FIELD OF THE INVENTION

The invention is directed to a medical device and method to apply repetitive compression forces to the front thorax of a person to aid blood circulation, loosening and elimination of mucus from the lungs of a person and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices as defined by the American Association for Respiratory Care Guidelines, 1991. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increased to 30 years with some patients living into their 50's and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

A demanding daily regimen is required to maintain the CF patient's health, even when the patient is not experiencing acute problems. A CF patient's CF daily treatments may include:

- Respiratory therapy to loosen and mobilize mucus;
- Inhalation therapy with anti-inflammatory drugs, bronchodilators and antibiotics for infections;
- Oral and intravenous antibiotics to control infection;
- Doses of Pulmozyme to thin respiratory mucus;
- 20 to 30 pancreatic enzyme pills taken with every meal to aid digestion;
- a low-fat, high-protein diet;
- Vitamins and nutritional supplements; and
- Exercise.

A lung transplant may be the only hope for patients with end stage cystic fibrosis.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. These devices use vests having air-accommodating bladders that surround the chests of persons. Mechanical mechanisms, such as solenoid or motor-operated air valves, bellows and pistons are disclosed in the prior art to supply air under pressure to diaphragms and bladders in regular pattern or pulses. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. External chest manipulation with high frequency chest wall oscillation was reported in 1966. Beck G J. *Chronic Bronchial Asthma and Emphysema. Rehabilitation and Use of Thoracic Vibrocompression, Geriatrics* (1966); 21: 139–158.

G. A. Williams in U.S. Pat. No. 1,898,652 discloses an air pulsator for stimulating blood circulation and treatment of tissues and muscles beneath the skin. A reciprocating piston is used to generate air pressure pulses which are transferred through a hose to an applicator having a flexible diaphragm. The pulsating air generated by the moving piston imparts relatively rapid movement to the diaphragm which subjects the person's body to pulsing forces.

J. D. Ackerman et al in U.S. Pat. No. 2,588,192 disclose an artificial respiration apparatus having a chest vest supplied with air under pressure with an air pump. Solenoid-operated valves control the flow of air into and out of the vest in a controlled manner to pulsate the vest, thereby subjecting the person's chest to repeated pressure pulses.

R. F. Gray in U.S. Pat. No. 3,078,842 discloses a bladder for cyclically applying an external pressure to the chest of a person. A pressure alternator applies air pressure to the bladder. A pulse generator applies air pressure to the bladder to apply pressure pulses to the chest of the person.

R. S. Dillion in U.S. Pat. No. 4,590,925 uses an inflatable enclosure to cover a portion of a person's extremity, such as an arm or leg. The enclosure is connected to a fluid control and pulse monitor operable to selectively apply and remove pressure on the person's extremity.

W. J. Warwick and L. G. Hansen in U.S. Pat. Nos. 4,838,263 and 5,056,505 disclose a chest compression apparatus having a chest vest surrounding a person's chest. A motor-driven rotary valve allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube.

C. N. Hansen in U.S. Pat. Nos. 5,453,081 and 5,569,170 discloses an air pulsating apparatus for supplying pulses of air to an enclosed receiver, such as a vest located around a person's chest. The apparatus has a casing with an internal chamber containing a diaphragm. An electric operated device connected to the diaphragm is operated with a pulse generator to vibrate the diaphragm to pulse the air in the chamber. A hose connects the chamber with the vest to transfer air and air pulses to the vest which applies pressure pulses to the person's chest.

N. P. Van Brunt and D. J. Gagne in U.S. Pat. Nos. 5,769,797 and 6,036,662 disclose an oscillatory chest compression device having a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. An air flow generator, shown as a blower, delivers air to the air chamber to maintain the pressure of the air in the chamber. Controls for the motors that move the diaphragm and rotate the blower are responsive to the air pressure pulses and pressure of the air in the air chamber. These controls have air pressure responsive feedback systems that regulate the operating speeds of the motors to control the pulse frequency and air pressure in the vest.

C. N. Hansen and G. E. McNamara disclose in U.S. Pat. Nos. 6,254,556 and 6,605,050 a vest used to apply repetitive pressure pulses to the front, sides and back of the thorax of a person. The vest has a cover with a pocket accommodating an air core. The air core has a plurality of upright air chambers and a bottom manifold passage connected to an air pressure pulsator. Air introduced into the manifold passage flows through a central back opening in the air core into the chambers thereby apply air pressure and pressure pulses to both the front, sides, and back of the chest of the person wearing the vest.

SUMMARY OF THE INVENTION

The invention comprises a vest used to apply pressure and repetitive pressure pulses to the front of the upper body or thorax of a person. The vest can be used by persons in prone positions, such as a person confined to a bed or a generally horizontal support. The vest has a one-piece outer cover comprising a flexible non-elastic sheet member or fabric. The cover has a front panel, a back panel, and shoulder members joining the front and back panels. The middle of the cover has a generally circular opening of a size to slip over a person's head to locate the vest around the person's thorax. Releasable fasteners connect the front and back panels to retain the vest around the person's thorax. A bladder having an internal chamber is secured to the inside surface of the front panel of the cover. The bladder has a flexible outside wall adapted to be located adjacent the front of the thorax of the person wearing the vest. The flexible wall can be in surface contact with the outer skin of the front of the person's thorax. The bottom portion of the bladder has a sleeve with an elongated air passage accommodating a flexible open member that allows air to flow in the air passage and into the air chamber. The bottom portion of the bladder is connected with a flexible hose to an air pulsator operable to generate air pressure and air pressure pulses which are transmitted to the air chamber of the bladder. The pressure forces and pressure pulses subjected to the bladder transmit repetitive pressure pulses to the front of the thorax of the person wearing the vest to enhance airway clearance and lung functions.

The vest cover has side flaps on the opposite sides of the back panel. A plurality of loop pads secured to the flaps cooperate with hook pads attached to opposite sides of the front panel to retain the vest around the thorax of a person. The loop and hook pads are VELCRO fasteners that releasably connect the front and rear panels and retain the vest in an adjusted position relative to the thorax of a person. The loop and hook pads permit circumferential adjustment of the vest to fit the girth of the thorax of the person. The bladder has an inside wall secured to the inside surface of the front panel and a flexible outside wall. The inside and outside walls surround an air chamber. The outside wall has a plurality of small holes that allow air to ventilate from the air chamber and deflate the bladder. Horizontal divider seals connecting the inner and outer walls of the bladder separate an air passage from the air chamber. The horizontal divide seals are spaced from each other providing a plurality of openings to allow air to flow from the air passage into the air chamber. Spacers, shown as loop pads, located through the openings between the seals ensure upward air flow from the air passage into the air chamber. The pulsing of air in the air chamber applies inward and upward pressure pulses to the front of the thorax of the person to facilitate airway clearance of secretions and lung functions. The open member is a flexible wire coil spring located in the air passage that maintains the air passage open to allow air to flow along the length of the air passage. The wire coil spring and non-elastic cover extended around the air passage limits inward pressure of the lower front end of the vest on the abdomen of the person. The coil spring is attached to a tubular clamp which extends through openings in the lower end of the bladder and cover. The clamp has an open end to allow the air pulsator to be connected to the clamp with an elongated hose to supply air pressure and air pressure pulses to the air in the air passage and air chamber of the bladder. The coil spring extends transversely along the bottom of the front panel of the vest. The back panel being flat and flexible does not inhibit a person wearing the vest from lying on a bed or support. The comfort of a supine person is not compromised.

DESCRIPTION OF PREFERRED EMBODIMENT

Figure 1:
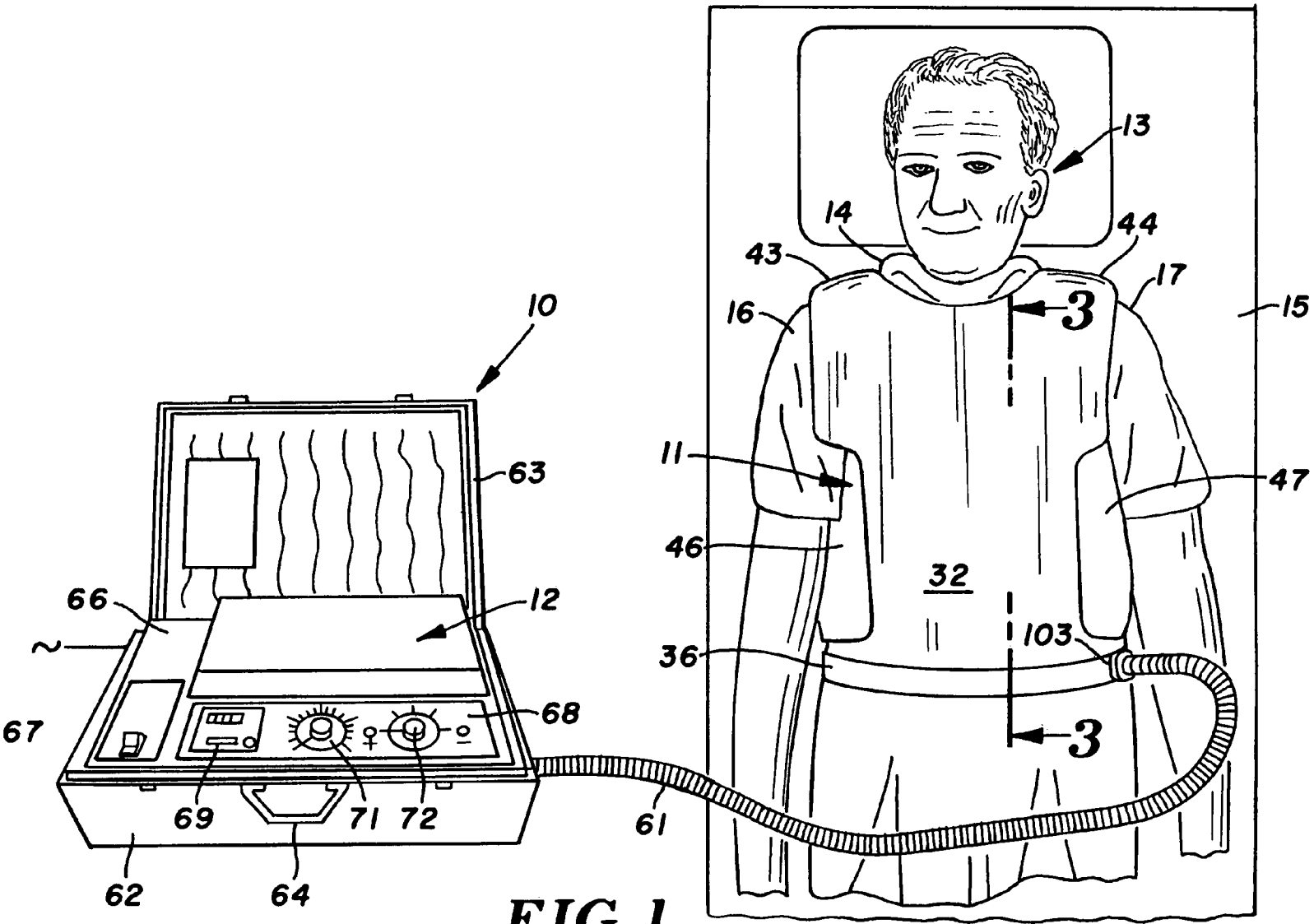
FIG. 1 is a front elevational view of the respiratory vest located on a supine person and connected to an air pulsator.

A pulsating apparatus, indicated generally at 10 in FIG. 1, includes a respiratory vest 11 and an air pressure and air pulse generator 12, known as a pulsator. Pulsating apparatus 10 is used to apply repetitive pressure pulses to the front of a person's thorax to enhance respiratory functions and provide secretion and mucus clearance therapy. An elongated flexible hose or tube 61 connecting vest 11 to generator 12 transfers air pressure and air pressure pulses from generator 12 to vest 11. An example of generator 12 is disclosed in U.S. Pat. No. 6,547,749 incorporated herein by reference. Other types of air pressure and pulse generators can be used to supply air pressure and pressure pulses to vest 11. Examples of air pressure and air pulse generators are disclosed in U.S. Pat. Nos. 1,898,652; 2,588,192; 2,918,917; 3,078,842; 4,838,263; 5,569,170 and 6,036,662.

As shown in FIG. 1, air pressure and pulse generator 12 is mounted in a case 62 having an open top and a cover 63 hinged to case 62 operable to close case 62. A handle 64 pivotally mounted on case 62 is used as a hand grip to facilitate transport of generator 12. Case 62 and cover 63 have overall dimensions that allow the case to be an aircraft carryon item.

Air pressure and pulse generator 12 has a top member 66 mounted on case 62 enclosing the operating elements of the pulsator. Top member 66 is not readily removable from case 62 to prohibit unauthorized adjustments and repairs of the operating components of the air pressure and pulse generator 12. Top member 66 supports a main electric power switch 67 and a front panel 68 having an operating timer 69, a pulse frequency control knob 71 and an air pressure control knob 73. Knobs 71 and 72 are manually rotated to adjust the frequency of the air pressure pulses and the air pressure in vest 11. Frequency control knob 71 and regulates a motor controller which controls the air pulse frequency from 5 to 25 cycles per second. The adjustment of the air pressure in vest 11 is controlled by turning knob 72. The air pressure in vest 11 is controlled between 0.1 and 1.0 psi.

Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients and paralyzed persons confined to beds in prone positions with respiratory distress syndrome have reduced mucociliary transport. Apparatus 10 provides high frequency chest wall oscillations or pulses to enhance mucus clearance in a person 13 with reduced mucociliary transport who are confined to a bed or generally horizontal support 15.

Figure 3:
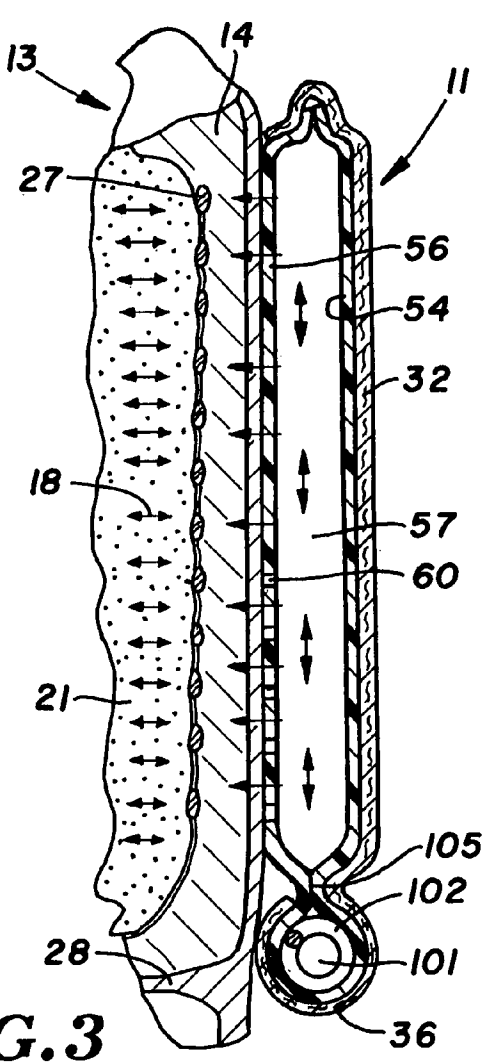
FIG. 3 is an enlarged sectional view taken along line 3—3 of FIG. 1.
Figure 2:
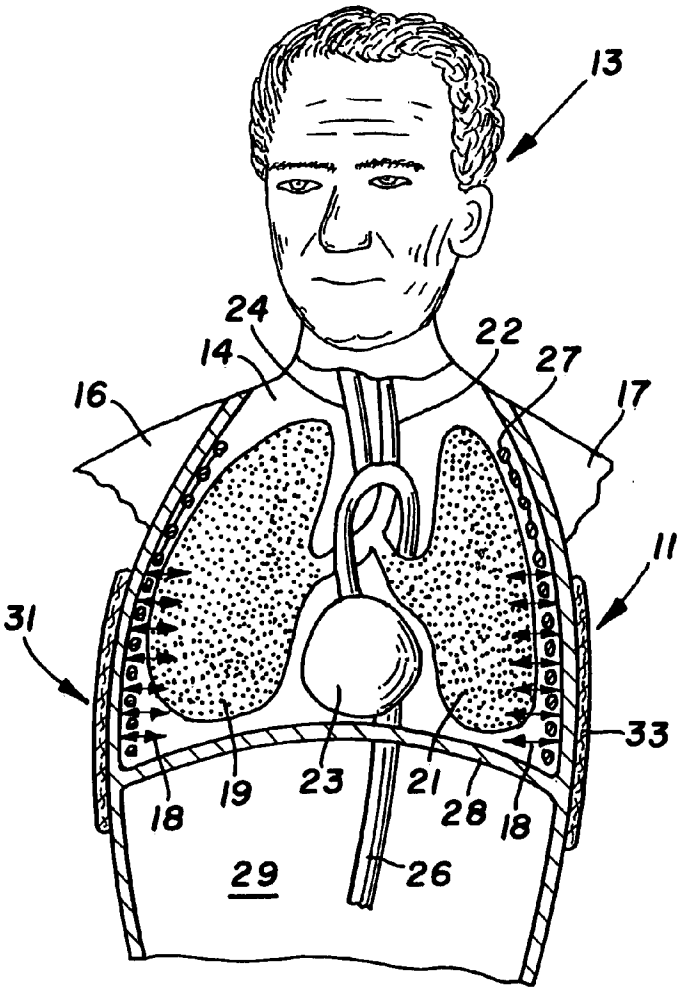
FIG. 2 is a transverse sectional view of the respiratory vest and person of FIG. 1.

Vest 11 located around the person's upper body or thorax 14 is supported on the person's shoulders 16 and 17. As shown in FIG. 3, vest 11 expanded into substantial surface contact with the exterior of the front of the thorax 14 functions to apply repeated compression or pressure pulses, shown by arrows 18 to the anterior or front portions of a person's lungs 19 and 21. The reaction of lungs 19 and 21 and trachea 22 to the pressure pulses causes repetitive expansion of the lung tissue when the pressure pulses are in the low pressure phase of the pressure cycle. The pressure pulses subjected to lungs 19 and 21 and trachea 22 provide secretions and mucus clearance therapy. The thoracic cavity occupies only the upper part of the thoracic cage and contains right and left lungs 19 and 21, heart 23, arteries 24 and 26, and rib cage 27. The repeated pressure pulses applied to thorax 14 stimulates heart 23 and blood flow in arteries 24 and 26 and veins in the chest cavity. Muscular and nerve tensions are also relieved by the repetitive pressure pulses imparted to the front portion of thorax 14. The lower part of the thoracic cage comprises the abdominal cavity 29 which reaches upward as high as the lower tip of the sternum so as to afford considerable protection to the large and easily injured abdominal organs, such as the liver, spleen, stomach, and kidneys. The two cavities are separated by a dome-shaped diaphragm 28. Rib cage 27 has twelve ribs on each side of the trunk. The ribs consist of a series of thin, curved, rather elastic bones which articulate posteriorly with the thoracic vertebrae. The spaces between successive ribs are bridged by intercostal muscles. The rib cage 29 aids in the distribution of the pressure pulses to the anterior portions of lungs 19 and 21 and trachea 22.

Figure 4:
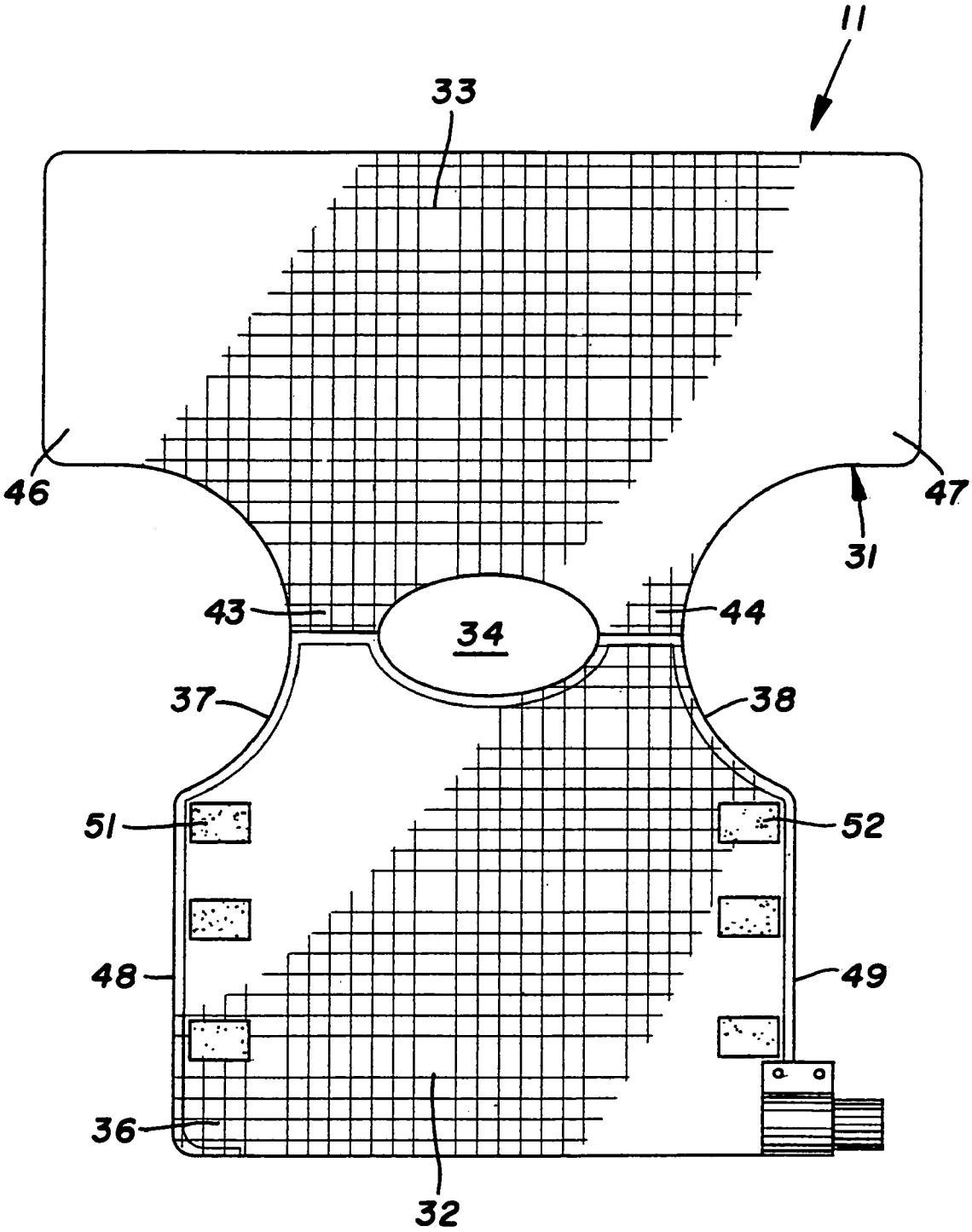
FIG. 4 is an enlarged outside front and rear plan view of the respiratory vest of FIG. 1.
Figure 5:
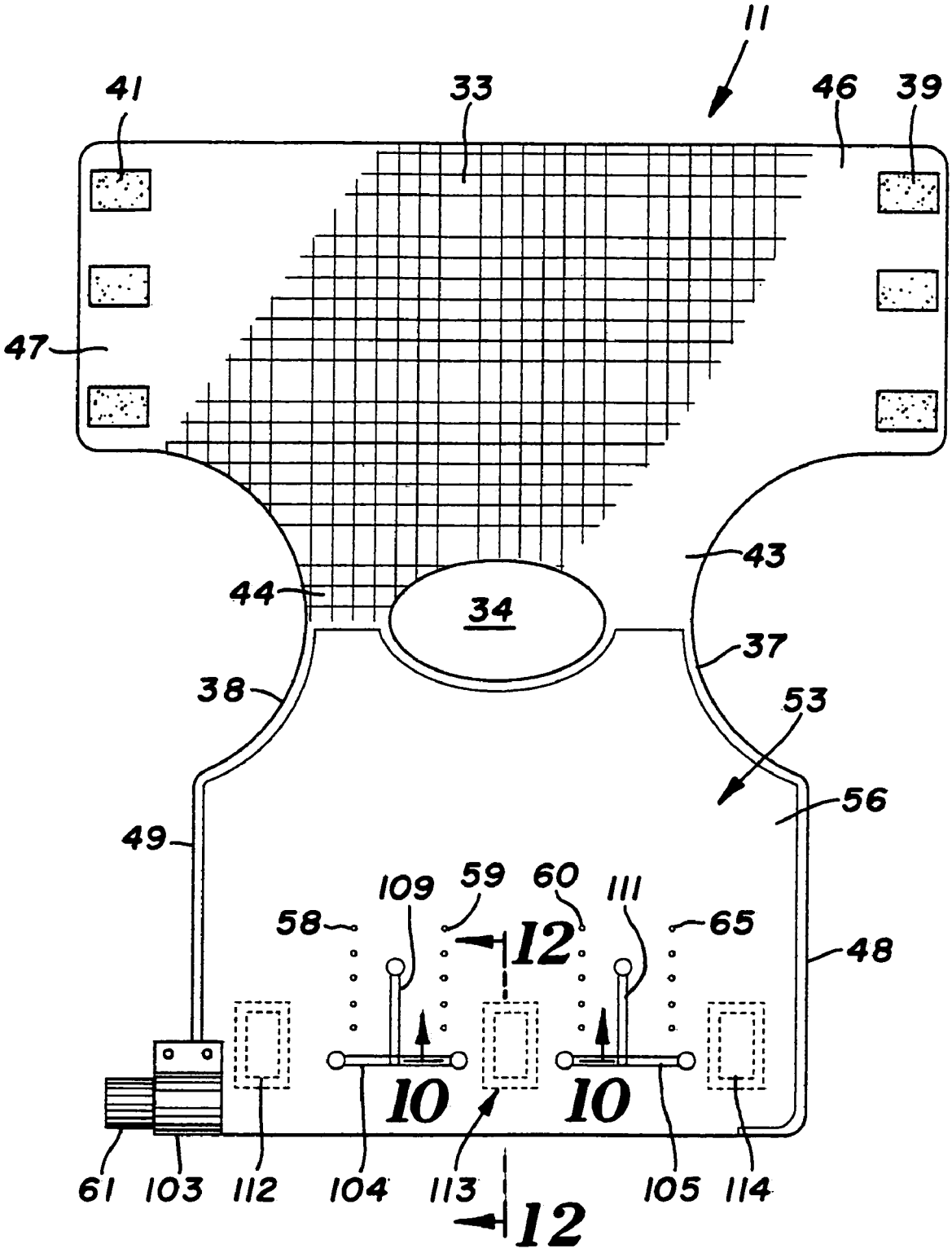
FIG. 5 is an enlarged inside front and rear plan view of the respiratory vest of FIG. 1.
Figure 6:
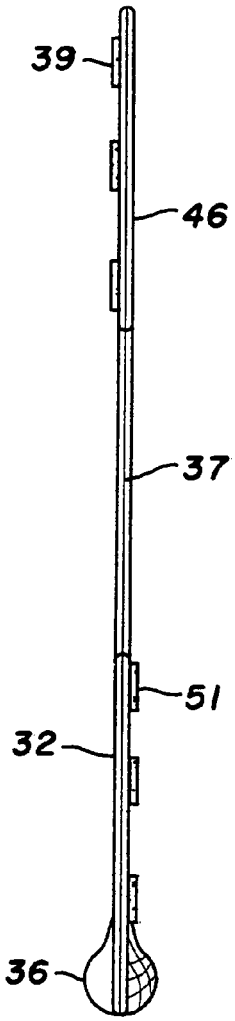
FIG. 6 is a side elevational view of the left side of the respiratory vest of FIG. 4.
Figure 7:
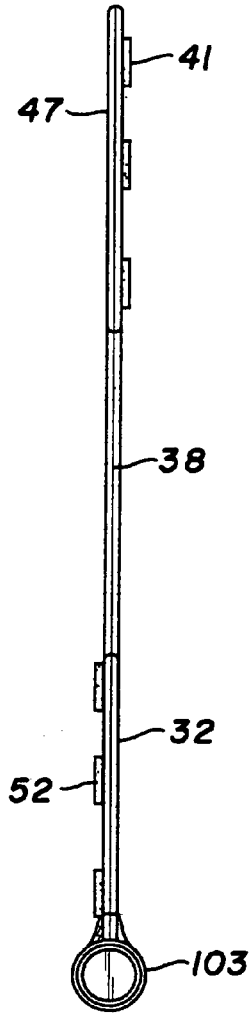
FIG. 7 is a side elevational view of the right side of the respiratory vest of FIG. 4.
Figure 8:
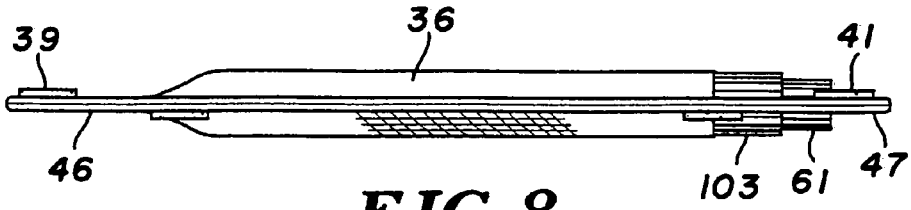
FIG. 8 is a top plan view of the left side of FIG. 4.
Figure 9:
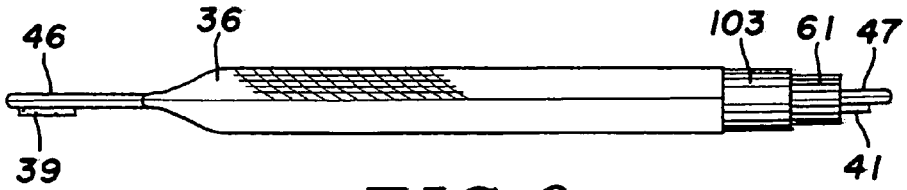
FIG. 9 is a bottom plan view of the respiratory vest of FIG. 4.

As shown in FIG. 4, vest 11 has an outside or anterior cover 31 comprising a flexible and generally non-elastic sheet, such as a nylon fabric. Other types of materials and fabrics can be used for cover 31. Cover 31 has a generally rectangular front panel 32 and a generally rectangular rear panel 33 connected to front panel 32 with shoulder portions 43 and 44. The central section of cover 31 has an opening 34 of a size to slip over the head of person 13 as shown in FIG. 1. The opposite sides of cover 31 have concave edges 37 and 38 to allow vest 11 to extend under the person's shoulder 16 and 17. As shown in FIGS. 5, 6 and 7 releasable fasteners, shown as hook-type pads 39 and 41, are secured to the outside of side flaps 46 and 47 located on opposite sides of rear panel 33. Pads 39 and 41 comprise rows of three spaced pads located adjacent the outside edges of flaps 46 and 47. Pads 39 and 41 can be loop-type pads adapted to be releasably attached to hook-type pads, known as VELCRO fasteners. Pads 39 and 41 can each be a single pad secured to flaps 46 and 47. Other types of releasable fasteners, such as releasable adhesives, can be used to attach flaps 46 and 47 to front panel 32. Front panel 32 has a transverse generally tubular bottom portion 36 and upright side edges 48 and 49. A plurality of loop-type pads 51 and 52 are secured to front panel 32 adjacent side edges 48 and 49. Pads 51 and 52 interact with pads 39 and 41 to releasably hold vest 11 about the thorax of person 13. Pads 39, 41 and 51, 52 are conventional VELCRO fasteners.

As shown in FIGS. 3, and 5, an air core or bladder, indicated generally at 53, is secured to the inside surface of front panel 32. A bladder 53 has an outer sheet member or wall 54 joined to an inner sheet member or wall 56. An adhesive or bonding material attaches outer sheet member 54 to panel 32. An air chamber 57 is located between sheet members 54 and 56. Sheet members 54 and 56 are flexible walls of plastic or fabric having inside layers or coatings of air impervious urethane plastic. The inner sheet member 56 has a plurality of upright rows of holes 58, 59, 60 and 65 to allow air to vent or allow air to flow from chamber 57 to atmosphere. Other types of air impervious flexible sheet members can be used for bladder 53. As shown in FIG. 5, bladder 53 covers the entire inside surface of front panel 32.

Figure 10:
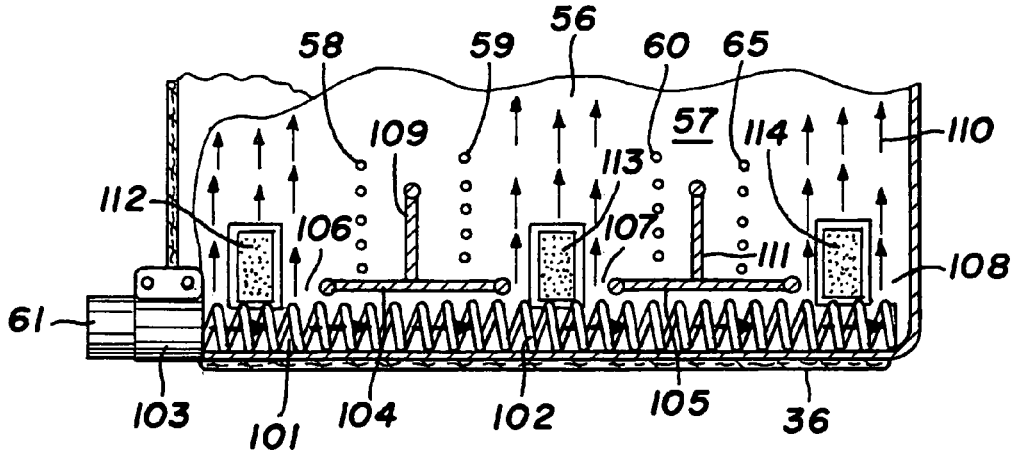
FIG. 10 is a transverse sectional view of bottom of the front of the respiratory vest of FIG. 5.
Figure 12:
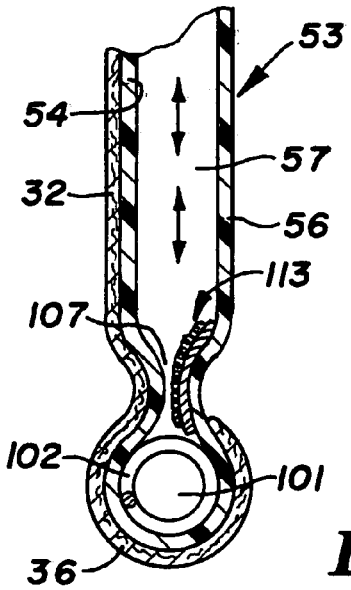
FIG. 12 is an enlarged sectional view taken along line 12—12 of FIG. 5.

As shown in FIGS. 10 and 12, the bottom portion 36 of the front panel 32 is a linear sleeve having an elongated transverse passage 101 accommodating a flexible open member shown as a coil spring 102. Spring 102 is a flexible metal coil spring that keeps passage 101 open for free flow of air and minimum interference of air pulses in passage 101. Other structures, such as a porous tube, in the air passage 101 can be used to provide for continuous air flow through passage 101 and into chamber 57. A tubular clamp 103 secured to the air inlet end of spring 102 accommodates the end of hose 61 to allow air from hose 61 to flow into passage 101. A pair of horizontal seals 104 and 105 joining linear sections of inner and outer sheet members 54 and 56 separate chamber 57 from passage 101 and confine coil spring 102 to passage 101. Seals 104 and 105 are spaced from each other and adjacent sides of bladder 53 to provide openings or passages 106, 107 and 108 to allow air to flow from passage 101 into chamber 57 of bladder 53. Upright seals 109 and 111 are joined to middle portions of seals 104 and 105 to direct air pulses upwardly into chamber 57. Seal 109 is parallel to and located between rows of holes 58 and 59. Seal 111 is parallel to and located between rows of holes 60 and 65. The air pulses, shown by arrows 110 in FIG. 10, directed upwardly in air chamber 37 exert upwardly and inwardly pulsed pressure forces to the front of the thorax of person 13 to enhance airway clearance of secretions and function of the lungs.

Figure 11:
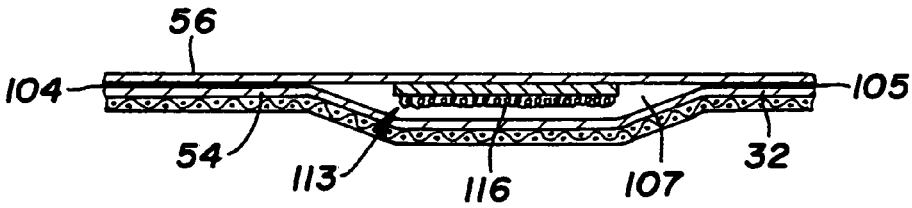
FIG. 11 is an enlarged sectional view taken along line 11—11 of FIG. 5.

As shown in FIGS. 10, 11 and 12, spacers 112, 113 and 114 extend through openings 106, 107 and 108 to maintain the passages open to ensure air flow and air pressure pulses from transverse passage 101 into air chamber 37. Spacers 112, 113 and 114 are rectangular loop pads 116 secured with an adhesive to the inside surface of inner member 56. The pads can be secured to the inside surface of outer member 54. Other types of spacers, such as short tubes, can be used to ensure air flow between passage 101 and air chamber 57.

In use, vest 11 is placed about the thorax of person 13 by pulling the vest over the person's head and locating the front panel 32 adjacent the front of the person's thorax. The rear panel 33 being a single sheet member is located adjacent the person's back. Flaps 46 and 47 are pulled over opposite side portions of front panel 32 to fit the vest around the person's thorax. Hook and loop pads 39, 52 and 41, 51 are pressed together to lock the flaps 46 and 47 to front panel 32. Flaps 46 and 47, as shown in FIG. 1, are above bottom portion 36 of vest 11 and above coil spring 102. The coil spring and non-elastic cover 31 extended around the spring and the location of the spring below flaps 46 and 47 limits inward pressure on the abdomen and organs therein and reduces stress on the digestive system. Air pulsator 12 is then connected with hose 61 to clamp 103. The operation of air pulsator 12 is started by turning switch 67 ON and setting timer 69 to the desired operating cycle. The rate of pulsation is controlled with control 71. The air flows from hose 61 into air passage 101 and openings 106, 107 and 108 upwardly into air chamber 37 of bladder 53. The pulsing of air in chamber 37 applies repetitive pressure pulses to the front of the thorax of the person's body. The operation of air pulsator 12 is described in U.S. Pat. No. 6,547,749. The air pulsator of U.S. Pat. No. 6,547,749 is incorporated herein by reference. Other types of air pressure and air pulse generators can be used to provide air pressure and air pressure pulses to vest 11.

The present disclosure is a preferred embodiment of the supine pulsating vest. It is understood that the supine pulsating vest is not to be limited to the specific materials, constructions and arrangements of structures shown and described. It is understood that changes in parts, materials, arrangement and locations of structures may be made without departing from the invention.

The invention claimed is:

1. A vest for applying repetitive pressure pulses to the front of the thorax of a person comprising: a cover having a front panel, a back panel and shoulder portions connecting the front panel to the back panel and an opening between said panels to allow the vest to be placed over a person's head and around the thorax of the person, releasable fasteners attached to the front and back panels operable to retain the vest around the thorax of the person, a bladder having an inner wall and an outer wall, means securing the outer wall to said front panel of the cover, said bladder having an air chamber between said inner and outer walls, an air receiving passage along a lower portion of the bladder for receiving pressurized air and air pressure pulses, openings between said inner and outer walls allowing air to flow from the air passage into the air chamber, an open member comprising a flexible coil spring located in and extended along the length of said air receiving passage for allowing air to flow in said passage and through said openings into the air chamber, and at least one hole in the inner wall for allowing air to flow out of the air chamber.

2. The vest of claim 1 wherein: said cover is a one-piece sheet member.

3. The vest of claim 1 wherein: said cover has opposite side edges, each of said edges having a concave portion.

4. The vest of claim 1 wherein: said back panel has flaps on opposite sides thereof, said releasable fasteners having first members attached to the flaps, and second members attached to the front panel, said first and second members cooperating with each other to secure the flaps to the front panel.

5. The vest of claim 4 wherein: the first and second members are hook and loop fasteners.

6. The vest of claim 1 wherein: bottom portions of the inner and outer walls have a plurality of spaced seals joining said walls, and spaces between the seals being open to provide said openings to allow air and air pressure pulses to flow upwardly from the air receiving passage into said air chamber.

7. The vest of claim 6 including: spacer means secured to one of said walls extended through said spaces between the seals to maintain said openings open.

8. The vest of claim 7 wherein: said spacer means comprise loop pads secured to one of said walls.

9. The vest of claim 1 including; a plurality of holes in the inner wall to allow air to flow out of the air chamber.

10. The vest of claim 9 including: upright seals securing the inner and outer walls together located adjacent said holes.

11. The vest of claim 1 including: upright rows of holes in the inner wall to allow air to flow out of the air chamber.

12. The vest of claim 11 including: upright seals securing the inner and outer walls together located between the upright rows of holes.

13. The vest of claim 1 wherein: said bottom portions of the inner and outer walls have a plurality of horizontal spaced first seals and upright second seals joined to the first seals joining the inner and outer walls, the space between the first seals being open to provide air flow passages open to said air chamber and air receiving passage to allow air to flow upwardly from the air receiving passage into said air chamber, and holes in said inner wall adjacent said upright seals to allow to flow out of the air chamber.

14. The vest of claim 13 including: spacer means secured to one of said walls extended through said spaces between the seals to maintain said passages open.

15. The vest of claim 14 wherein: said spacer means comprise loop pads secured to one of the walls.

16. A vest for applying repetitive pressure pulses to the front of the thorax of a person comprising: a one-piece non-elastic cover having a flat front panel with an inside surface, a back panel and shoulder members connecting the front panel to the back panel and an opening between said panels to allow the vest to be placed over a person's head and around the thorax of the person, said back panel having outwardly extended flaps on opposite sides thereof, releasable fasteners attached to the flaps and front panel operable to retain the vest around the thorax of the person, a bladder having an inner wall and a flexible outer wall, means securing the outer wall to the inside surface of the front panel, said bladder having an air chamber and an air receiving passage below said air chamber, said inner and outer walls having opposite sides and bottom portions, a plurality of horizontal laterally spaced seals securing the inner walls to the outer walls and separating the air receiving passage from the air chamber, said seals being spaced from each other and spaced from the opposite sides of the walls to provide openings between the air receiving passage and air chamber, an elongated coil spring located in the air receiving passage for allowing air to flow in the air receiving passage and through the openings into the air chamber, and holes in the inner wall for allowing air to flow out of the air chamber.

17. The vest of claim 16 wherein: the releasable fasteners have first members attached to the flaps, and second members attached to the front panel, said first and second members cooperating with each other to secure the flaps to the front panel.

18. The vest of claim 17 wherein: the first and second members are hook and loop fasteners.

19. The vest of claim 16 including: spacers secured to one of said walls extended through said openings to maintain said openings open to ensure air flow between the air receiving passage and air chamber.

20. The vest of claim 19 wherein: the spacers comprise loop pads secured to one of said walls.

21. The vest of claim 16 including: upright seals joined to the horizontal seals securing inner and outer walls together.

22. The vest of claim 21 wherein: said holes in the inner wall comprise upright rows of holes located adjacent said upright seals to allow air to flow out of the air chamber.

23. A bladder for a vest for applying repetitive pressure pulses to the front of the thorax of a person comprising: air impervious walls surrounding an air chamber and an air receiving passage, said walls including an inner wall and an outer wall, openings between said inner and outer walls allowing air to flow from the air receiving passage and said air chamber, an open member comprising a flexible coil spring located in and extended along the length of said air receiving passage to allow air to flow in said passage and through said openings into said air chamber, and at least one hole in one of said walls to allow air to flow out of the air chamber.

24. The bladder of claim 23 wherein: bottom portions of the inner and outer walls have a plurality of spaced seals joining said walls, and spaces between the seals being open to provide said openings to allow air and air pressure pulses to flow upwardly from the air receiving passage into said air chamber.

25. The bladder of claim 24 including: spacers secured to one of said walls extended through said spaces between the seals to maintain said openings open to ensure air flow between the air receiving passage and air chamber.

26. The bladder of claim 25 wherein: said spacers comprise loop pads secured to one of said walls.

27. The bladder of claim 23 including: a plurality of holes in the inner wall to allow air to flow out of the air chamber.

28. The bladder of claim 27 including: upright seals securing the inner and outer walls together located adjacent said holes.

29. The bladder of claim 23 including: upright rows of holes in the inner wall to allow air to flow out of the air chamber.

30. The bladder of claim 29 including: upright seals securing the inner and outer walls together located between the upright rows of holes.

31. The bladder of claim 23 wherein: said bottom portions of the inner and outer walls have a plurality of horizontal spaced first seals and upright second seals joined to the first seals joining the inner and outer walls, the space between the first seals being open to provide air flow passages open to said air chamber and air receiving passage to allow air to flow upwardly from the air receiving passage into said air chamber, and holes in said wall adjacent said upright seals to allow to flow out of the air chamber.

32. The bladder of claim 31 including: spacer means secured to one of said walls extended through said spaces between the seals to maintain said passages open.

33. The bladder of claim 32 wherein: said spacer means comprise loop pads secured to one of the walls.

34. A bladder for a vest for applying repetitive pressure pulses to the front of the thorax of a person comprising: an air impervious wall surrounding an air chamber and an air receiving passage having an open end providing an air inlet to the air receiving passage, said wall including an inner wall and a flexible outer wall, said inner and outer walls having opposite sides and bottom portions, a plurality of horizontal laterally spaced seals securing the inner wall to the outer wall and separating the air receiving passage from the air chamber, said seals being spaced from each other and spaced from the opposite sides of the walls to provide openings between the air receiving passage and the air chamber, and an elongated coil spring located in the air receiving passage for allowing air to flow in the air receiving passage and through the openings into the air chamber.

35. The bladder of claim 34 including: spacers secured to one of said walls extended through said openings to maintain said openings open to ensure air flow between the air receiving passage and air chamber.

36. The bladder of claim 35 wherein: the spacers comprise loop pads secured to one of said walls.

37. The bladder of claim 34 including: a plurality of holes in the inner wall to allow air to flow out of the air chamber.

38. The bladder of claim 34 including: upright seals joined to the horizontal seals securing inner and outer walls together.

39. The bladder of claim 38 including: upright rows of holes in the inner wall located adjacent said upright seals to allow air to flow out of the air chamber.

* * * * *